US006293693B1

(12) United States Patent
Rodgers et al.

(10) Patent No.: US 6,293,693 B1
(45) Date of Patent: Sep. 25, 2001

(54) METHOD AND APPARATUS FOR SANITARY MIXING OF VISCOUS MATERIALS

(75) Inventors: Kenneth W. Rodgers, Flower Mound; Gary D. Strong, Bedford, both of TX (US)

(73) Assignee: Mentor Corporation, Santa Barbara, CA (US)

( * ) Notice: Subject to any disclaimer, the term of this patent is extended or adjusted under 35 U.S.C. 154(b) by 0 days.

(21) Appl. No.: 09/291,928

(22) Filed: Apr. 14, 1999

(51) Int. Cl.[7] ..... B01F 7/16; B01F 15/02

(52) U.S. Cl. ..... 366/189; 366/190; 366/195; 366/245

(58) Field of Search ..... 366/242, 244, 366/245, 246, 247, 249, 251, 253, 254, 280, 139, 189, 194, 289, 190, 195, 196

(56) References Cited

U.S. PATENT DOCUMENTS 1,458,282 * 6/1923 Fairbanks ..... 366/289
2,990,978 * 7/1961 Charos ..... 366/196
4,457,629 * 7/1984 Liaw et al. ..... 366/139
4,889,432 * 12/1989 Patterson ..... 366/189
4,952,065 * 8/1990 Kreuziger ..... 366/247
5,633,329 5/1997 Hahnle et al. .
5,842,786 * 12/1998 Solomon ..... 366/189

* cited by examiner

*Primary Examiner*—Tony G. Soohoo
(74) *Attorney, Agent, or Firm*—Fish & Richardson P.C.

(57) ABSTRACT

A sanitary preparation apparatus having a vertically disposed tube, a port coupled to the tube for loading materials, and an end piece coupled to and sealing the bottom end of the tube is disclosed. A slidable platen having substantially the size and shape of the cross section of the tube is provided to close the mixing volume against contamination and to force the prepared material through a sealable connector coupled to the end piece. The platen has a passageway allowing a mixing mechanism including a shaft with attached impeller to be introduced into the mixing volume. One embodiment provides a second volume above the platen in which positive and negative gas pressures can be applied to move the platen within the tube. A method is disclosed for using the sanitary preparation apparatus to prepare a 4% cross-linked polyacrylamide (CPAM) hydrogel and to dispense the gel under pressure.

19 Claims, 4 Drawing Sheets

METHOD AND APPARATUS FOR SANITARY MIXING OF VISCOUS MATERIALS

BACKGROUND OF THE INVENTION

1. Field of the Invention

This invention relates to an apparatus and a method for sanitary mixing of viscous materials and, more particularly, to sanitary mixing of water and cross-linked polyacrylamide (CPAM) to form a hydrogel for use as a filler in implanted prostehesis.

2. Background Information

Highly viscous materials find many uses, including uses in the. Materials prepared for food, drug and cosmetic use must be prepared in a sanitary manner in compliance with Food and Drug Administration requirements. The material must be protected from outside contamination and be prepared in equipment having cleanable, non-reactive surfaces.

Conventional techniques for the sanitary preparation of highly viscous materials often involves preparation of the material in one device and then transfer of the material to another device for dispensing. For example, one method of manufacturing implantable prosthetic devices filled with a cross-linked polyacrylamide hydrogel requires hydration of the polyacrylamide in one device and then transfer to a pressure dispensing device for injection into the prosthetic shells.

One of the difficulties posed by the preparation of highly viscous, cohesive materials is that they will cling to the walls of the devices used in preparation. This complicates dispensing the prepared material and cleaning the preparation equipment after use.

It is also desirable to be able to prepare materials without exposing them to the atmosphere. This prevents exposure to air borne contaminants. In certain applications, it is desirable to prevent entraining air in the material. For example, air entrained in gels used in implantable prosthesis undesirably reduces radiolucency.

Accordingly, there is a need for a device which allows the preparation of highly viscous materials in a sanitary manner protected from contamination and entrainment of air and which allows the dispensing of prepared material without the need to transfer the material into another vessel.

SUMMARY OF THE INVENTION

A sanitary preparation apparatus having a vertically disposed tube, a port coupled to the tube for loading materials, and an end piece coupled to and sealing the bottom end of the tube is disclosed. A slidable platen having substantially the size and shape of the cross section of the tube is provided to close the mixing volume against contamination and to force the prepared material through a sealable connector coupled to the end piece. The platen has a passageway allowing a mixing mechanism including a shaft with attached impeller to be introduced into the mixing volume. One embodiment provides a second volume above the platen in which positive and negative gas pressures can be applied to move the platen within the tube. A method is disclosed for using the sanitary preparation apparatus to prepare a 4% cross-linked polyacrylamide (CPAM) hydrogel and to dispense the gel under pressure.

DETAILED DESCRIPTION OF THE INVENTION

The present invention provides an apparatus for the sanitary preparation of highly viscous materials, such as hydrogels used for the filling of implantable prosthetic devices, that protects the prepared material from contamination by outside air, prevents the entrainment of air in the prepared mixture, and allows the prepared mixture to be dispensed for filling without the need to transfer the material into a second vessel. The present invention also provides a method for using the device for the preparation of viscous materials, particularly hydrogels and, more particularly, polyacrylamide and cross-linked polyacrylamide (CPAM) gels.

Figure 1:
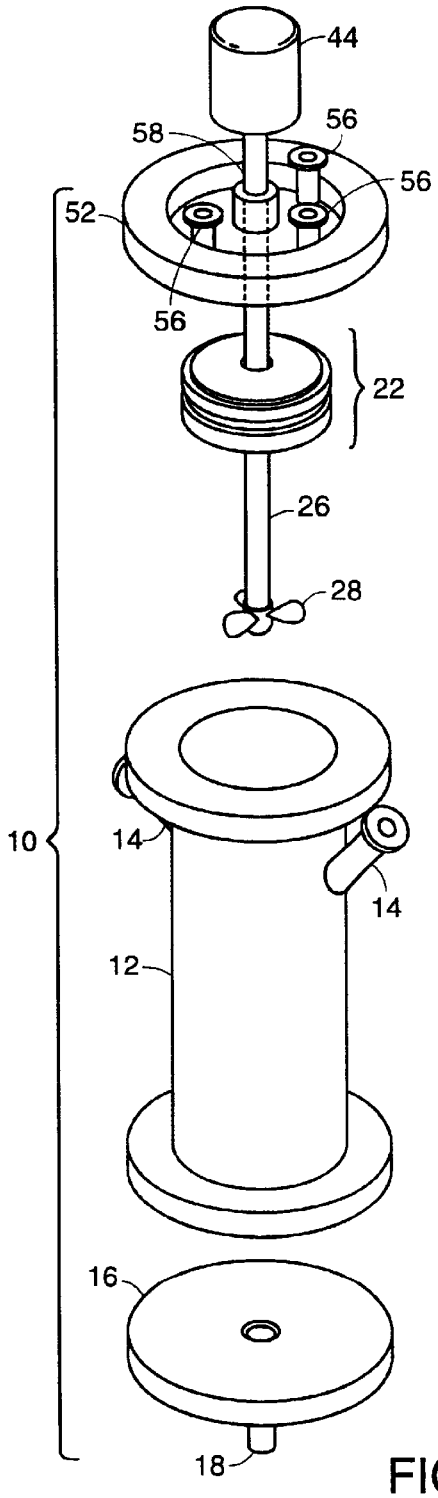
FIG. 1 is an exploded perspective view of an embodiment of the present invention.
Figure 2:
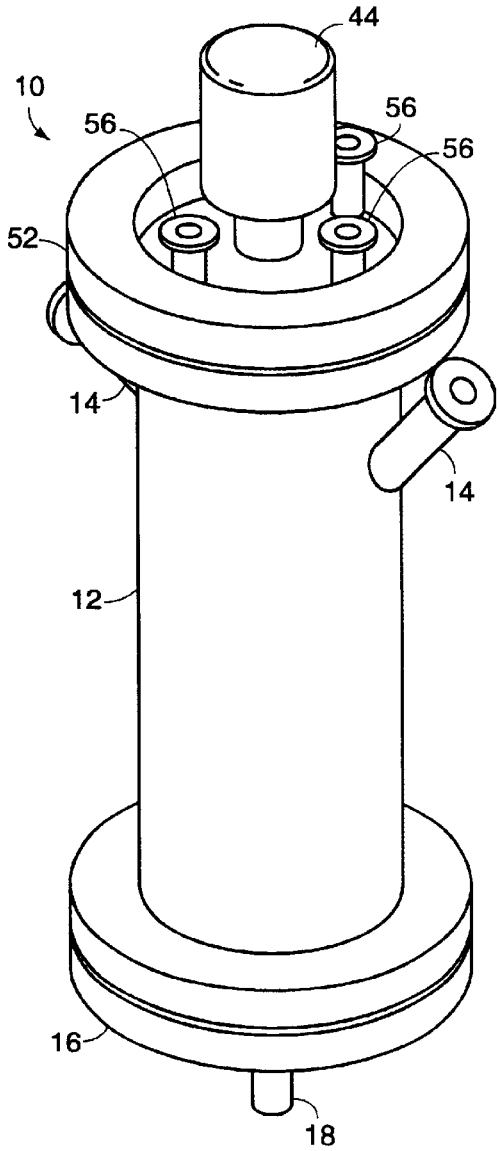
FIG. 2 is the device of FIG. 1 shown assembled for use in preparing a viscous material.
Figure 3A:
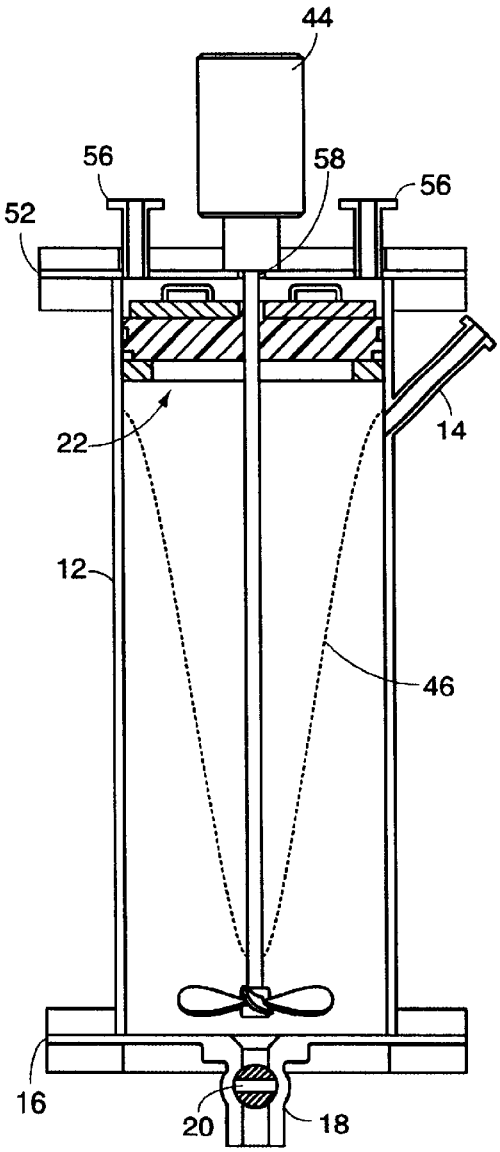
FIG. 3*a* is a the assembled device of FIG. 2 showing an operative configuration.

The preparation apparatus is constructed according to techniques of sanitary construction as are well known to those skilled in the art. As shown in FIG. 1, the preparation apparatus 10 includes a tube 12 which is vertically disposed, having an open top end and an opposing open bottom end. The tube 12 is preferably made of stainless steel having a circular cross-section. The tube 12 has ports 14 in the side of the tube 12 for the loading of materials for the preparation of the viscous material. The tube 12 is closed at its bottom end by an end piece 16 having a sealable connector 18. The connector may be closed by a sanitary type ball valve 20, best seen in FIG. 3*a*.

Figure 4:
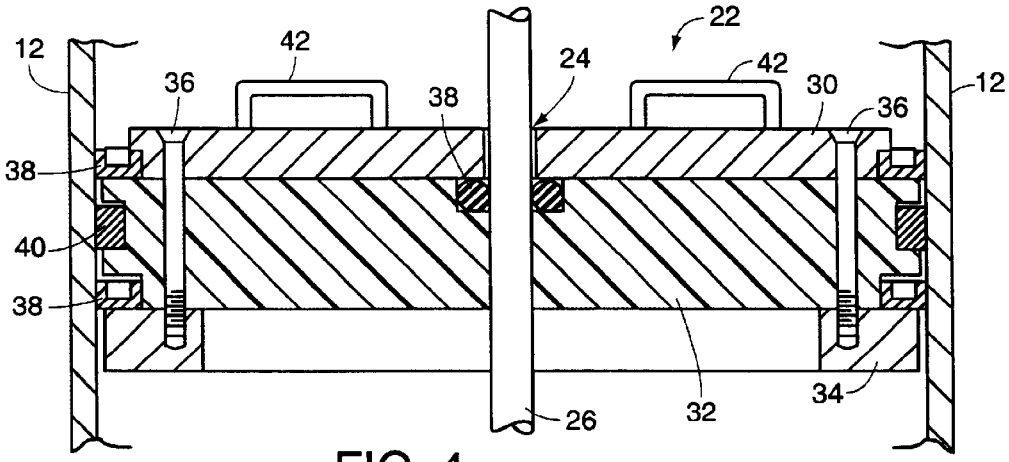
FIG. 4 is a cross-section of a platen as used in the present invention.

A platen 22 having substantially the size and shape of the cross-section of the tube is fitted into the tube 12 closing the top of a first volume in which the viscous mixture will be prepared. The platen 22 has a passageway 24, best seen in FIG. 4, which allows a shaft 26 to pass through the platen for the purpose of driving an impeller 28 for the mixing process. In one embodiment shown in FIG. 4, the platen includes a top plate 30, a middle plate 32, and a bottom plate 34 sandwiched together to form the body of the platen 22. Preferably the top 30 and bottom 34 plates are 316 stainless steel and the middle plate 32 is an ultra-high molecular weight plastic to provide a platen 22 with reduced sliding friction in the tube 12. The plates are held together by screws 36. Seals 38 on the outside and around the shaft passageway 24 seal the platen 22 against the side of the tube 12 and against the shaft 26 to prevent leakage from the first volume past the platen 22. A replaceable consumable ultra-high molecular weight plastic wear strip 40 may be provided on the edge of the middle plate 32. Handles 42 may be provided on the top plate 30 to facilitate assembly and disassembly of the platen from the tube 12.

The impeller 28 is coupled to the shaft 26, passes upwardly through the platen 22 and is coupled to a motive mechanism 44 which rotates the impeller 28. When the preparation apparatus 10 is assembled for use, the impeller 28 is raised some distance from the end piece 16. This distance may be critical to achieving an acceptable mixture. For example, it has been found, for a tube 12 having a diameter of ten inches and using an impeller 28 with a diameter of 7.68 inches for the preparation of a viscous material containing four percent cross-linked polyacrylamide (CPAM) by weight, that positioning the impeller 28 approximately 3 inches above the end piece 16 will produce a uniform mixture without lumps or air bubbles.

The preparation apparatus 10 is used to prepare a viscous material by assembling the first end piece 16 to the bottom end of the tube and opening the connector 18 in the first end piece. The impeller 28 is assembled to the shaft 26, the shaft 26 is inserted through the platen 22, and the platen 22 is inserted into the tube 12. The motive mechanism 44 is coupled to the shaft 26 after the shaft has been passed through the platen 22. The connector 18 at the bottom of the tube assembly is closed and a liquid component is introduced into the first volume through the port 14 in the side of the tube 12.

The impeller 28 is rotated to form a vortex 46. It has been found that the geometry of a vortex 46 may be important to forming satisfactory viscous mixtures. In the case of the preparation of the 4% CPAM gel, a vortex 46 having a bottom approximately 1½ inches above the impeller 28 has produced satisfactory results. It has been found that the rotational speed, in revolutions per minute, necessary to produce a satisfactory vortex and mixing is from sixteen to thirty-two times the volume of the mixture to be prepared, in liters. Because of the drag on the shaft 26 from the seals 38 and from the viscous mixture, it may be desirable to use a speed controller (not shown) that senses the actual rotational speed of the shaft 26 and controls the motive mechanism 44 as necessary to maintain the desired rotational speed of the shaft 26. It has also been found that the ratio of the diameter of the tube 12 to the length of the tube affects the formation of a good vortex and adequate mixing of the viscous material. For the preparation of the 4% CPAM gel, a ratio of length to diameter of about three to one has been found to produce satisfactory results.

Figure 3B:
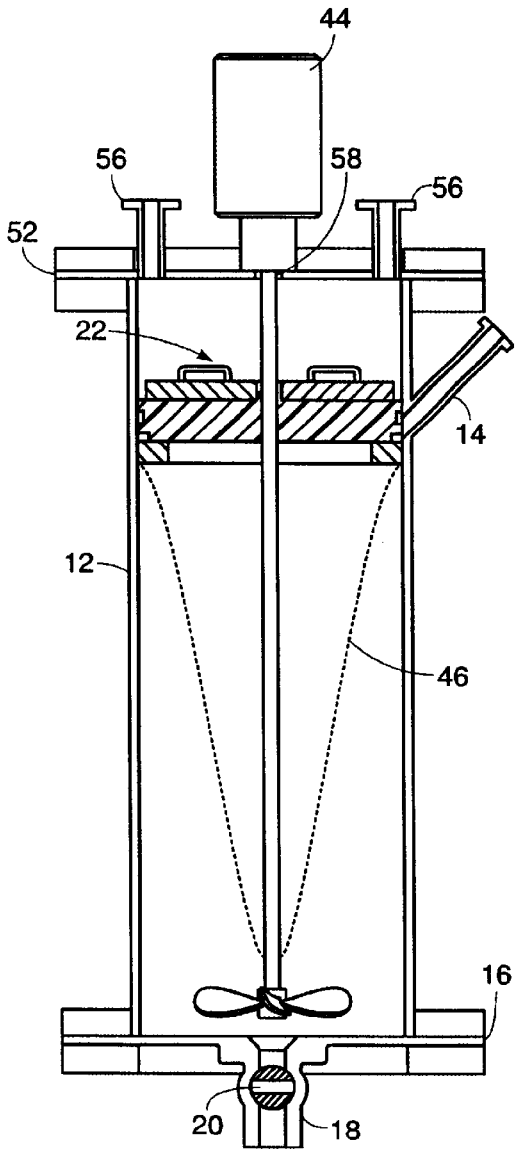
FIG. 3*b* is a the assembled device of FIG. 2 showing another operative configuration.

Once the vortex has formed, the gelling material can be added. The length of time during which the gelling material is added affects the quality of the material produced. Times between 2 and 20 seconds have been found to be satisfactory for the addition of granular CPAM. It may be desirable to lower the platen 22 to close off the inner ends of the ports 14 after addition of all components as shown in FIG. 3*b*. Mixing continues until a short time after the Weisenberg effect is produced in the viscous material. The Weisenberg effect is characterized by closing of the vortex of the stirred solution and the solution climbing the stirrer shaft. Total mixing times between 85 and 115 seconds after the addition of the gelling material have been found to be satisfactory for the preparation of 4% CPAM gel.

When the viscous material has formed, the motive mechanism 44 is stopped. The lower connection 18 is opened. The platen 22 is forced in an axial direction toward the lower end piece 16 by a platen actuator to dispense the viscous material. In one embodiment, a second end piece 54 is used to seal the top end of the tube 12 forming a second volume above the first volume and above the platen 22. A passageway 58 is provided in the second end piece 54 for the shaft 26. Seals are provided against the tube 12 and the shaft 26 so that the second volume can maintain vacuum or pressure. By creating positive and negative pressures in the second volume, the platen 22 can be moved up and down within the tube 12. This arrangement further protects the material being prepared from outside contamination. By introducing pressurized gas in the second volume through an upper connection 56, it is possible to dispense the viscous material under high pressure. For example, pressures of as much as 140 pounds per square inch gauge have been used to force the platen 22 down for the dispensing of the material.

Figure 6:
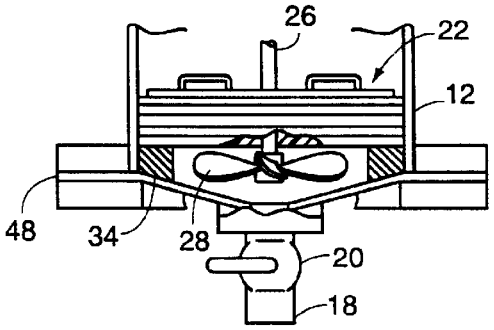
FIG. 6 shows an alternate embodiment of the device with the platen at the bottom-most position following discharge of the material.
Figure 7:
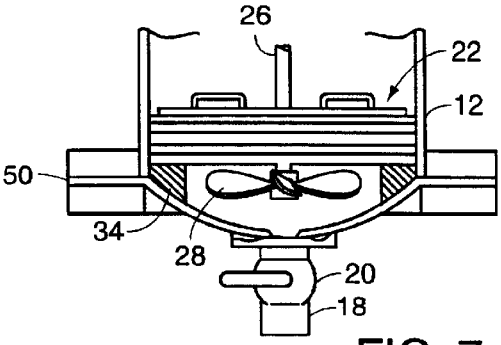
FIG. 7 shows an alternate embodiment of the device with the platen at the bottom-most position following discharge of the material.

In alternate embodiments, the lower end piece may be provided with a conical shape 48 (FIG. 6) or hemispherical shape 50 (FIG. 7) to aid in the dispensing of a viscous material, to avoid a sharp corner in which material will not be well mixed, and to promote the formation of a good vortex for mixing. The lower connector 18 is coupled to the shaped lower end piece at the lowest portion of the end piece.

Figure 5:
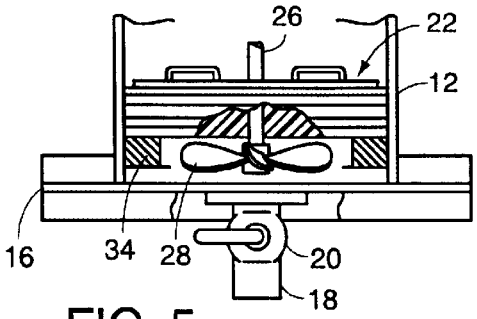
FIG. 5 is a detail of a device shown in FIG. 3 with the platen at the bottom-most position following discharge of the material.

The bottom plate 34 of the platen 22 may be recessed or an open ring to fit over the impeller 28 when the platen 22 is in the lowest position within the tube for dispensing of the viscous material. (FIGS. 5–7) The non-recessed portion of the bottom side of the platen is shaped to match the contours of the end piece so that the greatest amount of viscous material possible will be expelled from the preparation apparatus 10 during dispensing.

The following exemplary method has been used with a device embodying the present invention for the preparation of a hydrogel including four percent CPAM by weight. The preparation apparatus 10 was prepared as previously described with a vertical tube 12 of approximately 10 inches in diameter and 30 inches long, the lower end sealed with a hemispherical end piece 50, the platen 22 assembled with the impeller 28 and shaft 26 and motive mechanism 44, and the second end being closed by a top end piece 52. The first volume was evacuated and water was drawn into the first volume under vacuum. The water was then held under vacuum for approximately fifteen minutes to de-gas the water. Approximately 11.5 liters of water were drawn into the tube 12. The impeller 28 was then rotated at 280 revolutions per minute (RPM). Four hundred and eighty grams of CPAM powder were then added to the water within three to five seconds. The mixture was then mixed for approximately 100 seconds. The motive mechanism 44 was then stopped and the second volume was pressurized with high pressure nitrogen to approximately 60 pounds per square inch gauge and the bottom valve 20 was opened to dispense the resulting CPAM hydrogel.

It has been found that sieving CPAM granules to remove particles larger than 0.5 mm improves the quality of the hydrogel. Sieving to remove particles smaller than 0.25 mm may also be beneficial.

Figure 8:
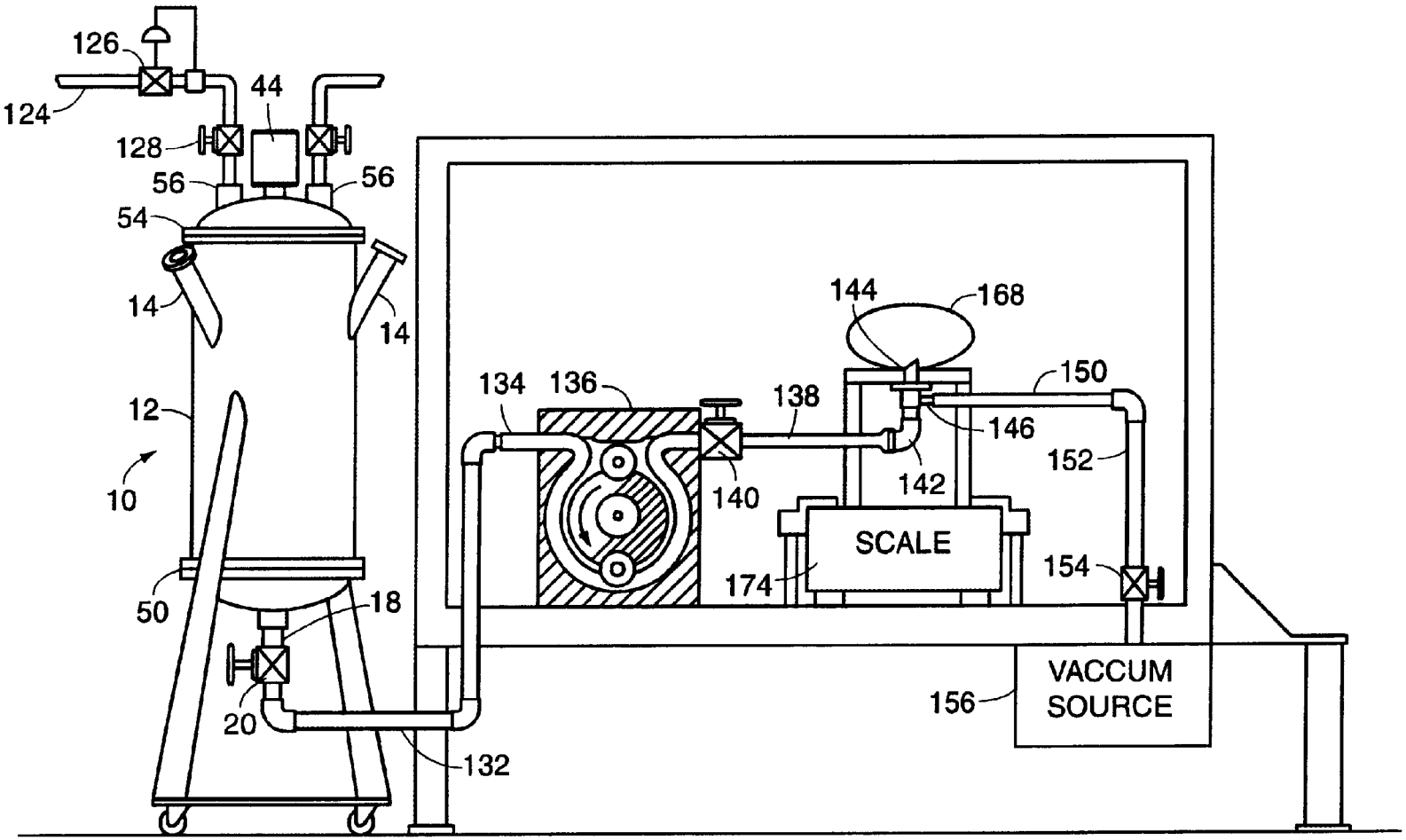
FIG. 8 shows an embodiment of the present invention as used in a prosthetic filling system.

FIG. 8 shows an embodiment of the present invention as used in a system for the filling of implantable prosthesis 168. The first inlet 146 of a cannula 144 is coupled through a flexible line 150 to a rigid line 152, and through a valve 154 to a vacuum source 156 powered by a conventional vacuum pump, preferably creating a vacuum of approximately 26 to 28 inches of mercury. The vacuum source 156 is used to evacuate the prosthesis 168 prior to filling. The preparation apparatus 10 is coupled through a valve 20 and a line 132 to a flexible hose 134 of a peristaltic pump 136, with the flexible hose 134 or an extension thereof 138, having a valve 140 therein, being coupled to a second inlet 142 of the cannula 144. In the embodiment shown, the preparation apparatus 10 has a hemispherical top end piece 54 for improved mechanical characteristic with respect to pressurization. In another embodiment (not shown), the peristaltic pump 136 is not used and the filling material is injected into the prosthesis 168 by pressurization of the preparation apparatus 10 alone.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A sanitary preparation apparatus comprising:

a tube, vertically disposed, having an open top end and an opposing open bottom end;

a port coupled to the tube;

a first end piece coupled to and sealing the bottom end of the tube;

a first sealable connector coupled to the first end piece;

a platen having substantially the size and shape of the cross section of the tube, having a first shaft passageway, slidably disposed within the tube, defining a first volume in the tube below the platen and above the first end piece;

an impeller;

a shaft coupled to the impeller and passing through the first shaft passageway; and a motive mechanism coupled to the shaft for rotating the impeller, wherein the platen seals against the tube and the shaft to prevent leakage to and from the first volume past the platen.

2. The sanitary preparation apparatus of claim 1 wherein the tube is a cylindrical tube.

3. The sanitary preparation apparatus of claim 2 wherein the tube has a length from 1 to 5 times the diameter of the tube.

4. The sanitary preparation apparatus of claim 2 wherein the tube has a length approximately 3 times the diameter of the tube.

5. The sanitary preparation apparatus of claim 2 wherein the impeller has a diameter from 0.6 to 0.9 times the diameter of the tube.

6. The sanitary preparation apparatus of claim 2 wherein the impeller has a diameter of approximately 0.75 times the diameter of the tube.

7. The sanitary preparation apparatus of claim 1 wherein the tube has a length of approximately 30 inches.

8. The sanitary preparation apparatus of claim 1 wherein the tube has a capacity for preparation of 2 to 25 kilograms of viscous material.

9. The sanitary preparation apparatus of claim 1 wherein the tube is a stainless steel tube.

10. The sanitary preparation apparatus of claim 1 further comprising a second end piece coupled to and sealing the top end of the tube, having a second shaft passageway sealing against the shaft, and a second connector coupled to the second end piece, wherein the platen defines a second volume in the tube above the platen and below the second end piece, whereby gas introduced into or withdrawn from the second volume through the second connector causes the platen to slide within the tube by creating a pressure difference between the second volume and the first volume.

11. The sanitary preparation apparatus of claim 10, wherein the second end piece has a generally hemispherical shape.

12. The sanitary preparation apparatus of claim 1 wherein the platen has a recessed portion and a non-recessed portion on a side facing the first volume whereby the platen closely fits over the impeller and against the first end piece to reduce the first volume.

13. The sanitary preparation apparatus of claim 12 wherein the first end piece has a generally conical shape, the first sealable connector is coupled to the lowest portion of the first end piece, and the non-recessed portion is conically shaped to closely fit against the first end piece.

14. The sanitary preparation apparatus of claim 12 wherein the first end piece has a generally hemispherical shape, the first sealable connector is coupled to the lowest portion of the first end piece, and the non-recessed portion is hemispherically shaped to closely fit against the first end piece.

15. The sanitary preparation apparatus of claim 1 further comprising a handle coupled to the platen on a side opposite the first volume to allow the platen to be withdrawn from the tube.

16. The sanitary preparation apparatus of claim 1 further comprising a platen actuator coupled to the platen for sliding the platen axially within the tube.

17. The sanitary preparation apparatus of claim 1 further comprising a speed controller coupled to the motive mechanism and to the shaft to control the motive mechanism responsive to the rotational speed of the shaft.

18. The sanitary preparation apparatus of claim 17 wherein the speed controller is adapted to maintain the rotational speed of the shaft in revolutions per minute at between 16 and 32 times a volume of viscous material being prepared in liters.

19. The sanitary preparation apparatus of claim 18 wherein the speed controller is adapted to maintain the rotational speed of the shaft in revolutions per minute at approximately 24 times a volume of viscous material being prepared in liters.

* * * * *